United States Patent [19]

Hill et al.

[11] Patent Number: 4,957,254

[45] Date of Patent: Sep. 18, 1990

[54] UNIVERSAL CONTAINER HOLDER

[76] Inventors: Johnny L. Hill, 1005 Evergreen, Longview, Tex. 75604; David E. Gormley, Rt. 1, Box 476, Pocola, Okla. 74902

[21] Appl. No.: 418,559

[22] Filed: Oct. 10, 1989

[51] Int. Cl.[5] ..... A47G 29/00

[52] U.S. Cl. ..... 248/207; 248/278; 248/311.2

[58] Field of Search ..... 248/205.5, 206.2, 206.3, 248/207, 220.2, 224.3, 223.4, 224.4, 278, 284, 309.1, 310, 311.2, 313, 314, 324; 224/42.45 R; 220/85 H, 903

[56] References Cited

U.S. PATENT DOCUMENTS

| | | | |
|---|---|---|---|
| D. 218,834 | 9/1970 | Smith . | |
| D. 228,335 | 9/1973 | Jackson | 220/85 H |
| D. 236,175 | 8/1975 | Wintz . | |
| 898,755 | 9/1908 | Little | 248/311.2 |
| 1,751,463 | 3/1930 | Backus | 224/42.45 R |
| 1,855,009 | 4/1932 | Clegg | 248/313 |
| 2,640,596 | 6/1953 | Reeder | 224/42.45 R |
| 2,926,879 | 3/1960 | Dietrich | 248/284 |
| 3,239,272 | 3/1966 | Wilkins . | |
| 3,367,714 | 2/1968 | Stone . | |
| 3,734,439 | 5/1973 | Wintz | 248/284 |
| 3,840,204 | 10/1974 | Thomas | 248/311.2 |
| 4,036,463 | 7/1977 | Hopkins | 248/309.1 |
| 4,174,866 | 11/1979 | Rhyan . | |
| 4,339,061 | 7/1982 | Dunn . | |
| 4,535,923 | 8/1985 | Manke | 224/42.45 R |
| 4,606,523 | 8/1986 | Statz | 220/85 H |
| 4,728,147 | 3/1988 | Dutton . | |

FOREIGN PATENT DOCUMENTS

| | | | |
|---|---|---|---|
| 362814 | 8/1962 | Switzerland | 248/223.4 |

*Primary Examiner*—Ramon O. Ramirez
*Assistant Examiner*—Robert A. Olson
*Attorney, Agent, or Firm*—John M. Harrison

[57] ABSTRACT

A universal container holder designed for receiving, supporting and orienting a beverage container in an upright configuration from a horizontal or a vertical surface or any surface disposed at an angle between the horizontal and vertical. In a first preferred embodiment the universal container holder is characterized by a clip element fitted with a supporting suction cup and provided with curved, spaced clip legs for receiving a corresponding bar tab of a T-bar element which may be attached to a receptacle designed to receive a beverage container. In a second preferred embodiment the T-bar element includes a beverage container receptacle. The T-bar element may be permanently attached to an insulated beverage container receptacle or an alternative container receptacle or it may be removably attached to the container receptacle, as desired. Engagement of the tab component of the T-bar with the curved clip legs, in combination with the rotatable or pivotal mounting of the clip to the supporting suction cup, insures that the beverage container placed in a container receptacle attached to or made a part of the T-bar, is able to swing in two planes oriented in perpendicular relationship with respect to each other and the beverage container will therefore remain upright at all times, regardless of the attitude of the suction cup and the structural member to which the suction cup is attached.

6 Claims, 2 Drawing Sheets

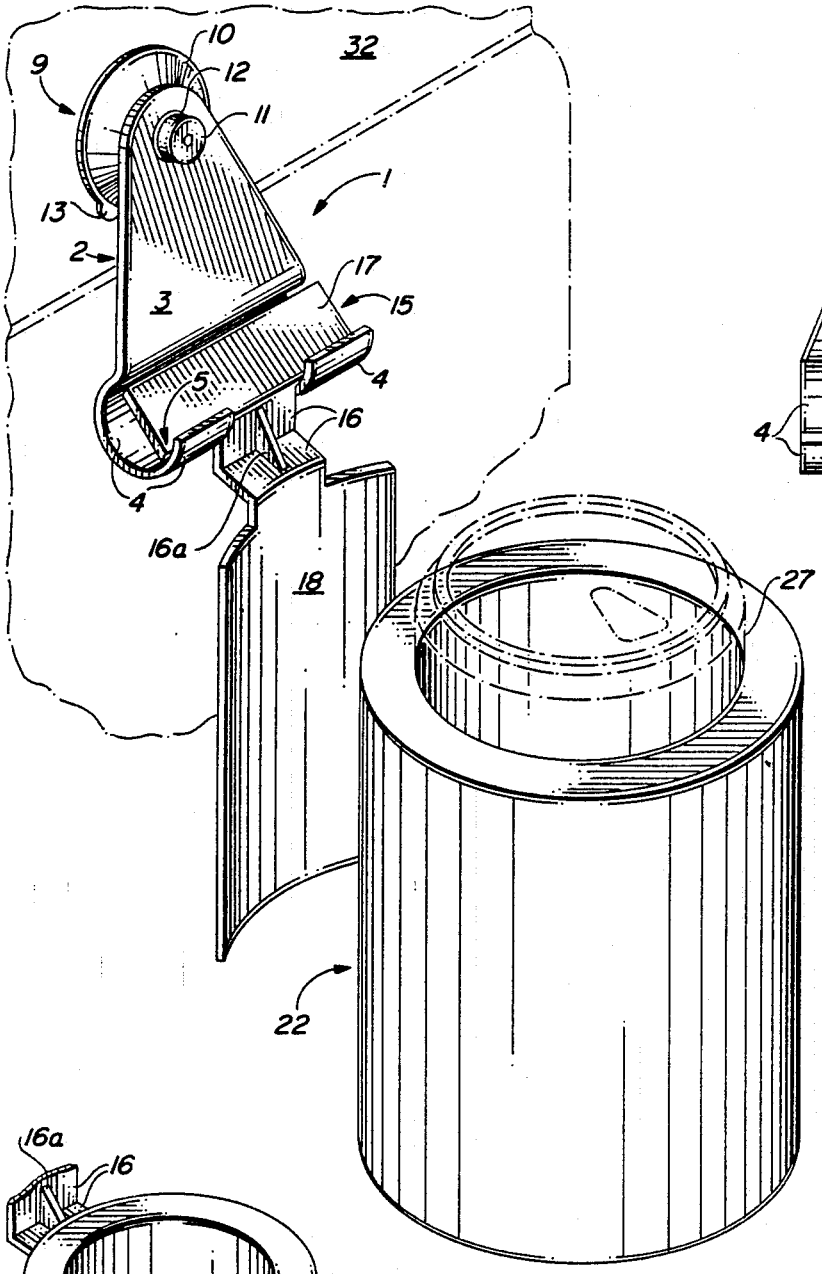
FIG. 1
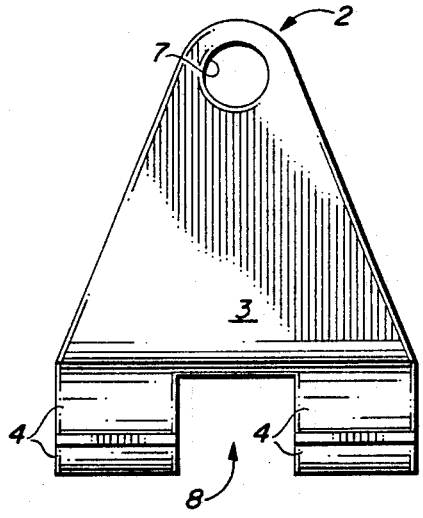
FIG. 5
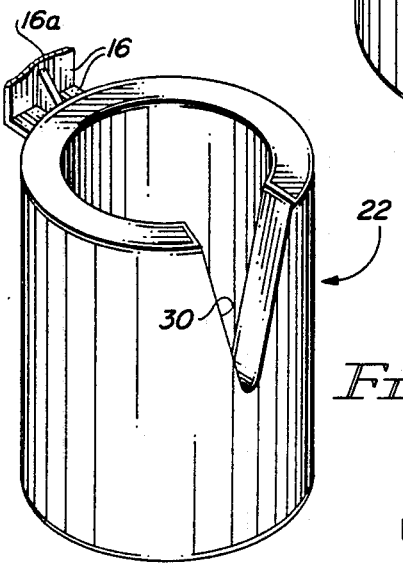
FIG. 2
FIG. 4
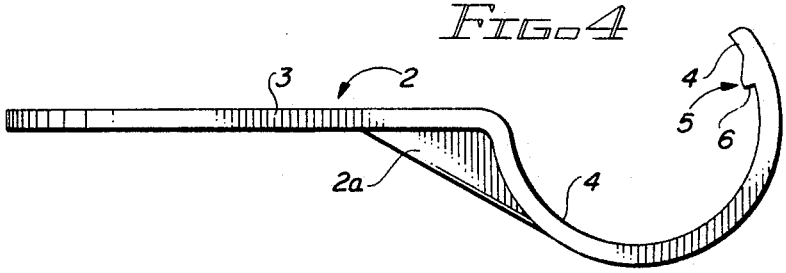

UNIVERSAL CONTAINER HOLDER

Background of the Invention

1. Field of the Invention

This invention relates to holders and receptacles for containers and more particularly, to a universal container holder which is designed to receive and support a beverage container in an upright configuration regardless of the attitude of the structure to which the universal container holder is attached or mounted. In a first preferred embodiment, the universal container holder is characterized by a clip element provided with a suction cup and having a pair of curved, upward-turned, spaced legs adapted for receiving the tab element of a T-bar component which may be attached to a beverage container receptacle by various methods. In another embodiment of the invention, the T-bar includes a container receptacle for receiving and supporting a beverage container. Engagement of the bar tab element of the T-bar and the curved clip legs of the clip is such that the suction cup may be attached to a horizontal or vertical surface or on a corresponding smooth surface disposed at any angle therebetween. The beverage container receptacle may either be permanently attached to or formed integrally with the T-bar portion of the universal container holder or it may be removably attached thereto, as desired. Since the clip element of the universal container holder is rotatably or pivotally secured to the suction cup, the beverage container receptacle is able to swing in two planes positioned in perpendicular relationship with respect to each other and is therefore maintained in an upright attitude, regardless of the movement or attitude of the support to which the suction cup is mounted, whether the suction cup is secured in a horizontal, vertical or angular configuration. This expedient is particularly important when the universal container holder is used in vehicles, aircraft and watercraft, wherein the vehicles, aircraft and watercraft may tilt or lean in one or more planes responsive to turning, accelerating and decelerating.

One of the problems which exists in receptacles designed for receiving and supporting beverage containers in vehicles, aircraft and watercraft is that of maintaining the receptacles in a stable position during turning, acceleration and deceleration. Slots, grooves and indentations normally provided for receiving beverage containers are of limited use in such applications, since a beverage can be easily spilled from the container during such leaning, acceleration and deceleration. The problem is particularly acute in aircraft and watercraft, where accentuated tilting of the aircraft and watercraft structure pursuant to turns in one or more planes frequently causes beverage containers to overturn or beverage to spill from the containers.

2. Description of the Prior Art

Various means have been devised in the prior art for preventing or at least minimizing the spilling of liquid beverages from containers under various circumstances. U.S. Pat. No. 3,239,272, dated Mar. 8, 1966, to D.H. Wilkins, details a "Snack Tray", which is designed to fit on the arm of a chair and receive various receptacles for containing beverages, as well as food. The snack tray is provided with a pair of spaced, adjustable clips for removable attachment to one arm of the chair and a third support member extends from the tray between the clips to the seat of the chair and is fitted with a third clip for attachment to the seat. U.S. Pat. No. 3,367,714, dated Feb. 6, 1968, to E.H. Stone, details a similar device for attachment to a lawn chair, wherein supporting panels are fitted with spring clips adapted to fit over and secure the panels to two mutually inclined frame members in the framework of the chair. U.S. Pat. No. 3,734,439, dated May 22, 1973, to Donald E. Wintz details a "Beverage Container Receptacle and Clamp", which includes a basket connected by means of a pivoting clip to a clamp mechanism, in order to maintain the basket in a free swinging configuration. A "Carrier Readily Attachable to a Support" is detailed in U.S. Pat. No. 4,174,866, dated Nov. 20, 1979, to William C. Rhyan. The device includes a frame which is characterized by a pair of spaced attaching arms and a member designed to receive and retain an article. A primary attaching arm is releasably retained on a horizontal arm, a portion of a chair or any other suitable horizontal support. A secondary arm attaching member is designed to be releasably retained on an adjacent vertical support frame member of the chair or any other suitable vertical support adjacent to the horizontal support. The releasably retained portions of the primary arm attaching member and the secondary arm attaching member are orthogonal to each other. U.S. Pat. No. 4,339,061, dated July 13, 1982, to Phillip Dunn, details an "Accessory Case For A Wheelchair". The accessory case includes a generally rectangular, box-like container having a hinged cover for mounting on the arm rest of a wheelchair. The case has a bottom wall provided with a forward position generally parallel to the cover and a rear portion which is canted or angled rearwardly and upwardly toward the cover. The case is mounted on the wheelchair with the cover located approximately at the level of the arm rest and the canted portion of the bottom wall is spaced from the wheelchair drive ring, leaving the drive ring free to be manipulated. U.S. Pat. No. 4,728,147 dated Mar. 1, 1988, to Ronald W. Dutton, details a "Lawn Chair Accessory". The apparatus is designed for use in holding styrofoam cup holders, styrofoam cups, drink cans, books, glasses and the like. The device is preferably attached to the arm of a lawn chair by a hook and loop fastener and is constructed of colored plastic of sufficient strength. It is designed to slide easily over the arm of the vast majority of lawn chairs and fasten to the arm in removable fashion. Design Pat. No. 218,834, dated Sept. 29, 1970, to Robert W. Smith, et al, details a "Mounting Clip for a Receptacle Holder" and Design Patent No. 236,175, dated Aug. 5, 1975, to Donald E. Wintz, details a "Receptacle for Drink Holders".

It is an object of this invention to provide a new and improved universal container holder for orienting a beverage container in a substantially upright configuration regardless of the attitude of the structure to which the universal container holder is mounted.

Another object of this invention is to provide a universal container holder which is characterized by a clip element adapted for fixed or removable attachment to a structure and a corresponding T-bar element engaging the clip element in articulated, removable relationship and adapted to removably receive and support a beverage container receptacle for maintaining the beverage container receptacle and a beverage container supported therein in a substantially upright condition regardless of the attitude of the structure to which the clip element is attached.

A further object of this invention is to provide a new and improved universal container holder which is characterized by a clip element fitted with a suction cup for removable attachment to a smooth surface and a T-bar member adapted to engage the clip element in removable, articulated fashion and permanently fitted with a receptacle for receiving a beverage container, wherein the receptacle and beverage container are maintained in an upright, substantially vertical orientation regardless of the attitude of the structure to which the suction cup is attached.

Yet another object of this invention is to provide a new and improved universal container holder for maintaining a beverage container in upright, substantially vertical relationship, which universal container holder is characterized by a clip element provided with a suction cup for mounting on a horizontal, vertical, or angular smooth surface, a pair of curved legs projecting from the bottom of the clip element in spaced relationship for receiving the bar tab of a T-bar element, which T-bar element is removably or fixedly attached to, or formed integrally with a beverage container receptacle, wherein the clip element is free to swing with respect to the suction cup in a first plane and the bar tab is free to articulate with respect to the clip legs in a second plane which is perpendicular to the first plane, in order to maintain the beverage container receptacle in the desired upright orientation.

Summary of the Invention

These and other objects of the invention are provided in a new and improved universal container holder which is characterized in a first preferred embodiment by a flat clip element pivotally or rotatably fitted with a suction cup and a pair of upward-turned, curved, spaced legs provided with leg retainers, for removably receiving the flat bar tab of a T-bar element. The T-bar element is designed to removably receive and support a beverage container receptacle, wherein pivoting or swinging of the clip element with respect to the suction cup and articulation between the bar tab of the T-bar and the clip legs of the clip facilitate maintenance of the beverage container receptacle in an upright, substantially vertical configuration regardless of the attitude of the structure to which the suction cup is attached. In a second preferred embodiment of the invention the T-bar element is permanently attached to, or shaped integrally with the beverage container receptacle.

Brief Description of the Drawing

The invention will be better understood by reference to the accompanying drawings, wherein:

FIG. 1 is a perspective view of a first preferred embodiment of the universal container holder of this invention;

FIG. 2 is a perspective view of an alternative preferred insulated receptacle for use with the universal container holder illustrated in FIG. 1;

FIG. 4 is a side view of the clip element of the universal container holder;

FIG. 5 is a front view of the clip element illustrated in FIG. 4;

Description of the Preferred Embodiments

Figure 9:
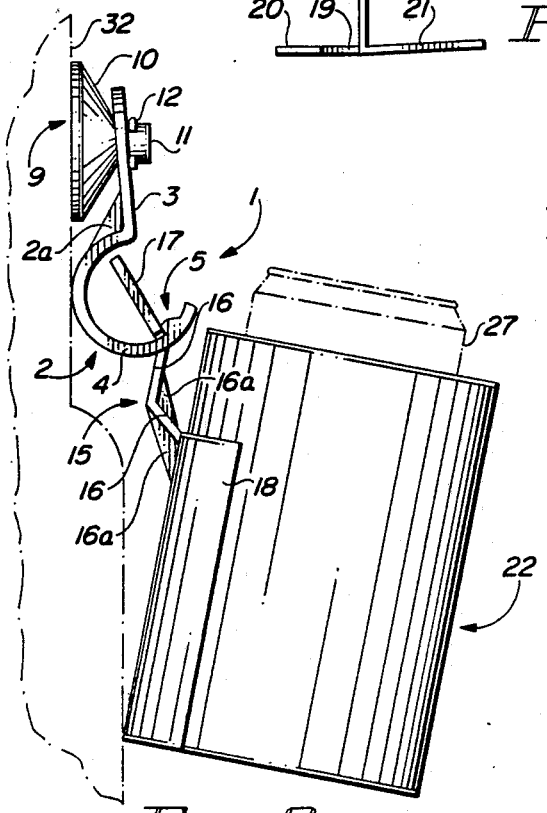
FIG. 9 is a side view of the universal container holder in functional configuration suspending an insulated receptacle containing a beverage container from a vertical surface.

Referring initially to FIGS. 1, 4, 5 and 9 of the drawings, in a preferred embodiment the universal container holder of this invention is generally illustrated by reference numeral 1. In a most preferred embodiment of the invention the universal container holder 1 is characterized by a generally triangular-shaped clip 2, having an upper flat support portion 3. A pair of spaced, curved clip legs 4 extend from the bottom of the support portion 3 to define a clip slot 8, as illustrated in FIG. 5, and a leg retainer 5 is provided in the inside curved surface of each of the clip legs 4, as illustrated in FIG. 4. As further illustrated in FIG. 4, each leg retainer 5 is characterized by a retainer shoulder 6, which is provided for a purpose which will be hereinafter described. A mount opening 7 is provided in the upper flat support portion 3 of the clip 2, as illustrated in FIG. 5, and is designed to receive the mount 11 of a suction cup 9, in order to secure the clip 2 to the suction cup 9 in rotatable, pivotal or swinging relationship. A mount clip 12 is used to retain the mount 11 in the mount opening 7 of the support portion 3 in this swinging relationship, as illustrated in FIG. 9. The suction cup 9 is further characterized by a saucer-shaped gripping portion 10, which is designed to create a vacuum when attached to a flat, smooth surface, such as the vertical support surface 32, illustrated in FIGS. 1 and 9, according to the knowledge of those skilled in the art. One or more tabs 13 may be provided on the outer periphery of the gripping portion 10, in order to conveniently lift one side of the gripping portion 10 and break the underlying vacuum when it is desired to remove the suction cup 9 from the vertical support surface 32.

As further illustrated in FIGS. 1 and 6–9, the flat bar tab 17 of a T-bar 15 is designed to engage the inside surfaces of the clip legs 4 of the clip element 2 in articulated, but removable relationship. The T-bar 15 is further characterized by a V-shaped bar neck 16, braced by bar neck gussets 16*a* and terminated at one end by the bar tab 17 and at the opposite end by a connecting strap 18. As further illustrated in FIG. 1, the bar tab 17 of the T-bar 15 is designed to slidably engage the curved clip legs 4 of the support portion 3 of the clip 2, as the bar neck 16 registers with the clip slot 8 defined by the spaced clip legs 4. As illustrated in FIGS. 1 and 9, the connecting strap 18 may be curved for removable or fixed attached to an insulated receptacle 22, which is designed to receive a beverage container 27, illustrated in phantom. Accordingly, the inside curved surface of the connecting strap 18 may be coated with a sticky material or either the loop or pile element of a loop-pile fastener (not illustrated}may be attached thereto and the opposite element secured to the insulated receptacle 22, for removably attaching the insulated receptacle 22 to the connecting strap 18, according to the knowledge of those skilled in the art. Alternatively, the insulated receptacle 22 can be shaped integrally with, glued or otherwise fixed to the connecting strap 18.

Referring to FIG. 2, the insulated receptacle 22 may be provided with a vertical handle slot 30 to accommodate the handle of a mug (not illustrated), in order to increase the versatility of the insulated receptacle 22.

Figure 3:
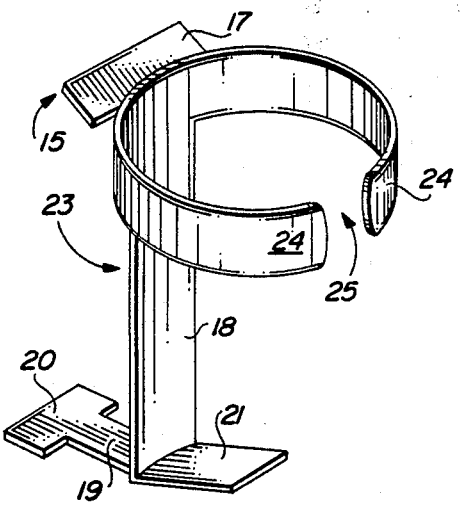
FIG. 3 is a perspective view of an alternative collar receptacle for use with the universal container holder illustrated in FIG. 1.
Figure 6:
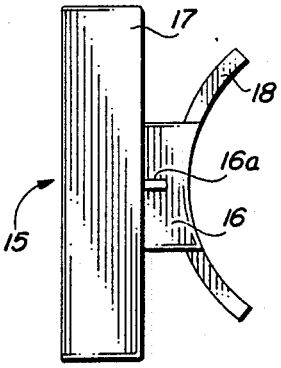
FIG. 6 is a top view of the T-bar element of the universal container holder illustrated in FIG. 1.
Figure 7:
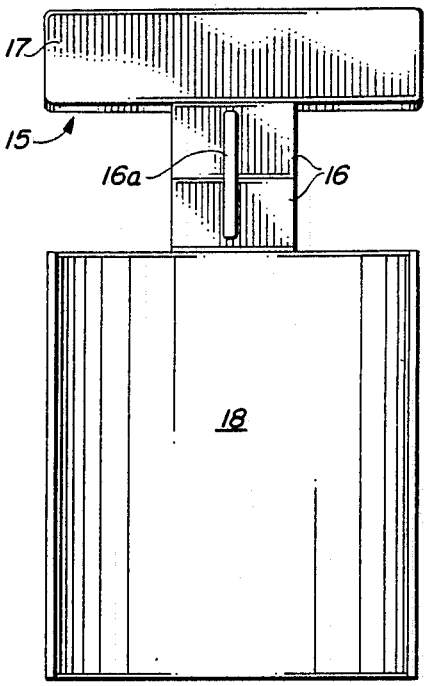
FIG. 7 is a front view of the T-bar element illustrated in FIG. 6.
Figure 8:
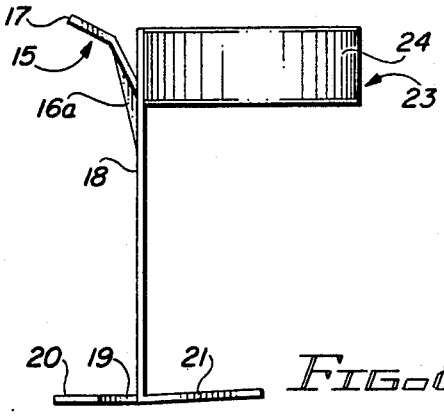
FIG. 8 is a side view of the collar receptacle illustrated in FIG. 3.

Referring now to FIGS. 3 and 8, in another preferred embodiment of the invention the insulated receptacle 22 may be replaced by a collar 23, defined by resilient collar fingers 24, which are spaced by a finger slot 25, which collar 23 is removably or fixedly attached to, or shaped integrally with the connecting strap 18 of the T-bar 15. Moreover, a support strap 21 is provided for supporting a beverage container {not illustrated), by extending a corresponding horizontal spacing strap 19 from the bottom of the connecting strap 18 beneath the collar fingers 24. A spacing tab 20 is provided on the end of the spacing strap 19 for engaging a vertical surface (not illustrated) and orienting the collar receptacle 23 in a nearly vertical configuration.

Figure 10:
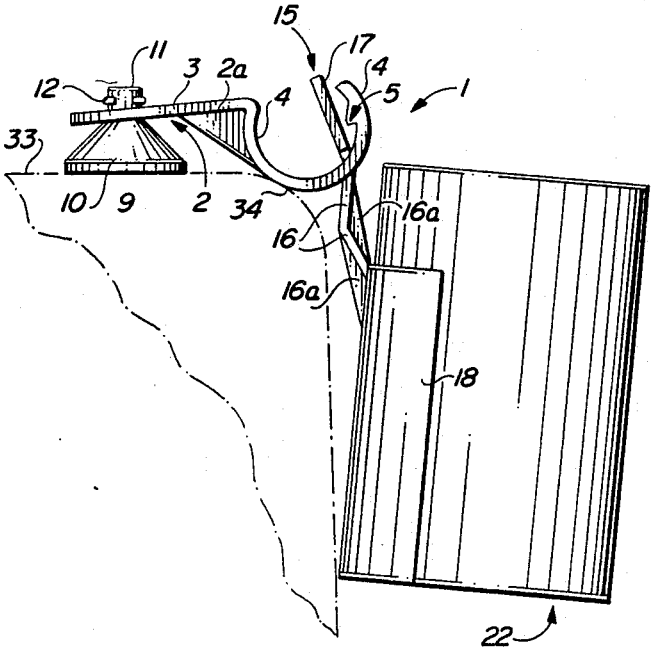
FIG. 10 is a side view of the universal container holder in functional configuration suspending an insulated receptacle containing a beverage container from a horizontal surface.

Referring now to FIG. 10 of the drawings, it will be appreciated that the articulated relationship between the bar tab 17 of the T-bar 15 and the curved clip legs 4 of the clip 2 facilitates attachment of the gripping portion 10 of the suction cup 9 to a horizontal support surface 33, illustrated in phantom. The location of the suction cup 9 on the horizontal support surface 33 is chosen such that the outside surfaces of the curved clip legs 4 engage the rounded support surface shoulder 34 and allow the bar neck 16 of the T-bar 15 to project downwardly and support the insulated receptacle 22 at a slight angle with respect to the vertical. This support angle is characteristic of the universal container holder 1 and facilitates easy access to the beverage container 27, as illustrated in FIG. 9.

It will be appreciated from a consideration of the drawings that the universal container holder 1 of this invention is capable of supporting a beverage container 27 in a substantially upright position, regardless of the attitude and movement of the structural surface to which the suction cup 9 is attached. This is facilitated by swinging of the clip 2, T-bar 15 and insulated receptacle 22 or collar receptacle 23 at the mount 11 of the suction cup 9 in a first plane and the T-bar 15 and insulated receptacle 22 or collar receptacle 23 in a second plane perpendicular to the first plane, by articulation at the bar tab 17 and clip legs 4. Furthermore, the suction cup 9 can be attached to the supporting surface either in the horizontal configuration as illustrated in FIG. 10, or in the vertical position as illustrated in FIG. 9. Moreover, it will be also appreciated by those skilled in the art that the suction cup 9 can be attached to any smooth surface which is disposed at any angle between the horizontal and vertical, as desired, in light of the articulated relationship between the T-bar 15 and the clip 2. Further, as illustrated in FIGS. 4 and 9, the retainer shoulder 6 of the leg retainer 5 is designed to receive the edges of the bar tab 17 of the T-bar 15 when the suction cup 9 is attached to a vertical support surface 32, in order to prevent the T-bar 15 from exiting the clip legs 4 and spilling beverage from the container 27.

Referring again to the drawings, while the suction cup 9 provides a versatile mechanism for removably securing the universal container holder 1 to a smooth surface, it will be appreciated that the clip 2 can be secured to the desired structural member either permanently or temporarily by screws, bolts and like fasteners, in non-exclusive particular. Accordingly, while the preferred embodiments of the invention have been described above it will be recognized and understood that various modifications may be made therein and the appended claims are intended to cover all such modifications which may fall within the spirit and scope of the invention.

Having described my invention with the particularity set forth above, what is claimed is:

1. A universal container holder for supporting a beverage container from a structure, comprising a clip adapted for mounting on the structure, said clip characterized by a support portion, engaging means carried by said support portion for engaging the structure and a pair of curved legs projecting from said support portion in spaced relationship, said curved legs having an arcuate, concave receiving surface; and a T-bar adapted for engaging said clip and supporting the beverage container in an upright configuration, said T-bar characterized by a bar tab for engaging said arcuate, concave receiving surface of said clip in articulating relationship, a bar neck extending from said bar tab and receptacle means carried by said bar neck for receiving and supporting the beverage container.

2. The universal container holder of claim 1 further comprising a leg retainer provided in each of said curved legs for engaging said bar tab of said T-bar and preventing said T-bar from sliding from said curved legs.

3. The universal container holder of claim 2 wherein said receptacle means further comprises a connecting strap extending from said bar neck, collar means provided on one end of said connecting strap for receiving a beverage container and a support strap provided on the opposite end of said connecting strap and extending beneath said collar means for supporting the beverage container in said collar means.

4. The universal container holder of claim 2 wherein said receptable means further comprises an insulated receptacle.

5. The universal container holder of claim 4 further comprising a vertical slot provided in said insulated receptacle for receiving the handle of a mug.

6. A universal container holder for suspending a beverage container receptacle from a structure and maintaining the beverage container receptacle in an upright configuration, comprising a clip characterized by a support portion; a suction cup pivotally carried by said support portion for removably engaging the structure and pair of curved legs projecting from said support portion in spaced relationship, said curved legs having an arcuate, concave receiving surface; a T-bar characterized by a bar tab for engaging said arcuate concave receiving surface of said curved legs in articulated, slidable relationship; a bar neck extending from said bar tab; a leg retainer provided in each of said curved legs for engaging said bar tab and preventing said bar tab from sliding from said curved legs; and a connecting strap carried by said bar neck for receiving and supporting the beverage retainer receptacle, whereby said clip, said T-bar and the beverage container receptacle are free to swing in a first plane responsive to pivoting of said support portion with respect to said suction cup and said T-bar and the beverage container receptacle are free to swing in a second plane disposed perpendicular to said first plane responsive to articulation and sliding of said bar tab on said arcuate, concave receiving surface of said curved legs.

* * * * *